United States Patent [19]

Kobayashi et al.

[11] Patent Number: 4,850,468

[45] Date of Patent: Jul. 25, 1989

[54] MONEY DISCRIMINATING APPARATUS

[75] Inventors: Osamu Kobayashi, Tsurugashima; Masaki Akagawa, Hatoyama, both of Japan

[73] Assignee: Nippon Conlux Co., Ltd., Tokyo, Japan

[21] Appl. No.: 166,440

[22] Filed: Mar. 10, 1988

[30] Foreign Application Priority Data

Mar. 25, 1987 [JP] Japan ..... 62-42741[U]
Dec. 28, 1987 [JP] Japan ..... 62-329655

[51] Int. Cl.[4] ..... G07F 7/04; G07D 5/08; G07D 7/00

[52] U.S. Cl. ..... 194/207; 194/318; 209/534

[58] Field of Search ..... 194/206, 207, 318, 334, 194/338; 453/7, 11, 31, 32, 56; 209/534; 232/7, 9, 10

[56] References Cited

U.S. PATENT DOCUMENTS 3,347,249 10/1967 Becker ..... 453/31
3,667,485 6/1972 Sesko ..... 194/207
3,939,954 2/1976 Collins ..... 194/334 X
4,072,156 2/1978 Abe ..... 453/11
4,536,709 8/1985 Ishida ..... 194/206 X

*Primary Examiner*—F. J. Bartuska
*Attorney, Agent, or Firm*—Koda and Androlia

[57] ABSTRACT

A money discriminating apparatus comprising a bill transporting path defined between a pair of spaced, but opposed wall surfaces. A coin transporting path is defined by a groove formed in at least one of the wall surfaces. The groove has a width slightly larger than a diameter of a largest one of coins to be transported and a depth slightly larger than a thickness of a thickest one of the coins. Inlet and outlet of coin transporting path open respectively to inlet and outlet of the bill transporting path. A transporting system transports bill and coin along their respective paths. A discriminating unit discriminates authenticity and kind of bill and coin in course of being transported along their respective paths. Preferably, the transporting system comprises a pair of transporting belts and mating surfaces arranged in facing relation respectively to running surfaces of the respective belts. The running surfaces of the respective belts cooperate respectively with the mating surfaces to transport money while clamping the money therebetween.

16 Claims, 3 Drawing Sheets

MONEY DISCRIMINATING APPARATUS

BACKGROUND OF THE INVENTION

The present invention relates to a money discriminating apparatus for use in money handling machines such as, for example, automatic vending machines and money exchange machines in which bills and coins can be utilized.

In general, a money handling machine such as an automatic vending machine and a money exchange machine is limited in overall size or dimension from the viewpoint of installation space. In view of this, various attempts have been made to reduce the overall dimension of the money handling machine by the use of special component parts and special techniques in a money discriminating apparatus incorporated in the money handling machine. However, such attempts often cause a complication in construction of the money discriminating apparatus as is in the conventional apparatuses, resulting in an increase in the manufacturing cost of the money handling machine.

The above-described conventional money handling apparatus comprises a coin discriminating unit which is divided broadly into two types including a mechanical type in which authenticity and kind of coins are discriminated in a mechanical manner, and an electronic type in which authenticity and kind of coins are discriminated in an electronic manner. In either case of the mechanical and electronic types, the coins successively roll down under the gravity along a coin transporting path, and the coin discriminating unit discriminates the authenticity and kind of the coins during successive rolling-down of the coins along the coin transporting path. Accordingly, there might occur such a problem that if adhesive contamination adheres to the coins, they lodge in the coin transporting path. Further, in case of the coin discriminating unit of mechanical type, if the coins successively rolling down along the coin transporting path jump midway of the path, the coin discriminating unit cannot correctly discriminate the authenticity and kind of the coins. In particular, the coin discriminating unit employing a cradle might discriminate in error counterfeit coins as being genuine ones, if the entire money discriminating apparatus is inclined.

The usual electronic coin discriminating unit comprises a signal generating coil and a signal receiving coil which are arranged in confronting relation to each other through the coil transporting path. The arrangement is such that the electronic coin discriminating unit measures attenuation voltage wave form occurring in the signal receiving coil when the coins rolling down along the coin transporting path passes successively between both the coils, thereby discriminating the coins. It is desirable for such arrangement that the coins successively rolling down along the coin transporting path are constant in speed. However, the speed of the coins successively rolling down along the coin transporting path varies depending upon humidity and contamination at the coin transporting path. Accordingly, the coin discriminating unit is required to take variation in speed of the coins into consideration in order to correctly discriminate the authenticity and kind of the coins. This results in a complication in construction of the coin discriminating unit, and also results in an increase in the manufacturing cost of the entire money discriminating apparatus.

SUMMARY OF THE INVENTION

It is an object of the invention to provide a money discriminating apparatus which is simple and compact in structure, and which is low in manufacturing cost.

It is another object of the invention to provide a money discriminating apparatus which can discriminate coins in a stable manner without being influenced by contamination and deformation of coins and by the posture of the discriminating apparatus.

According to the invention, there is provided a money discriminating apparatus comprising:

a bill transporting path defined between a pair of spaced, but opposed wall surfaces, the bill transporting path having at its one end an inlet and at the other end an outlet;

a coin transporting path defined by a groove formed in at least one of the pair of wall surfaces, the groove having a width slightly larger than a diameter of one having a maximum diameter, of coins to be transported, and a depth slightly larger than a thickness of one having a maximum thickness, of the coins to be transported, the coin transporting path having an inlet and an outlet which open respectively to the inlet and the outlet of the bill transporting path;

transporting means for transporting a bill from the inlet to the outlet of the bill transporting path along the same and for transporting a coin from the inlet to the outlet of the coin transporting path along the same;

bill discriminating means arranged in association with the bill transporting path, for discriminating authenticity and kind of the bill in course of being transported by the transporting means along the bill transporting path; and coin discriminating means arranged in association with the coin transporting path, for discriminating authenticity and kind of the coin in course of being transported by the transporting means along the coin transporting path.

According to the invention, there is also provided a money discriminating apparatus comprising:

a coin transporting path defined by a groove formed in at least one of a pair of spaced, but opposed wall surfaces, the groove having a width slightly larger than a diameter of one having a maximum diameter, of coins to be transported, and a depth slightly larger than a thickness of one having a maximum thickness, of the coins to be transported, the coin transporting path having an inlet and an outlet;

transporting means for transporting a coin at a constant speed from the inlet to the outlet of the coin transporting path along the same; and coin discriminating means arranged in association with the coin transporting path, for discriminating authenticity and kind of a coin in course of being transported by the transporting means along the coin transporting path, wherein the transporting means comprises transporting belt means having a running surface, and mating surface means arranged in facing relation to the running surface of the transporting belt means, and drive means for driving the transporting belt means to run the same, the arrangement being such that when the transporting belt means is driven by the drive means, the running surface of the transporting belt means cooperates with the mating surface means to transport the coin while clamping the coin between the running surface of the transporting belt means and the mating surface means.

DETAILED DESCRIPTION

Figure 1:
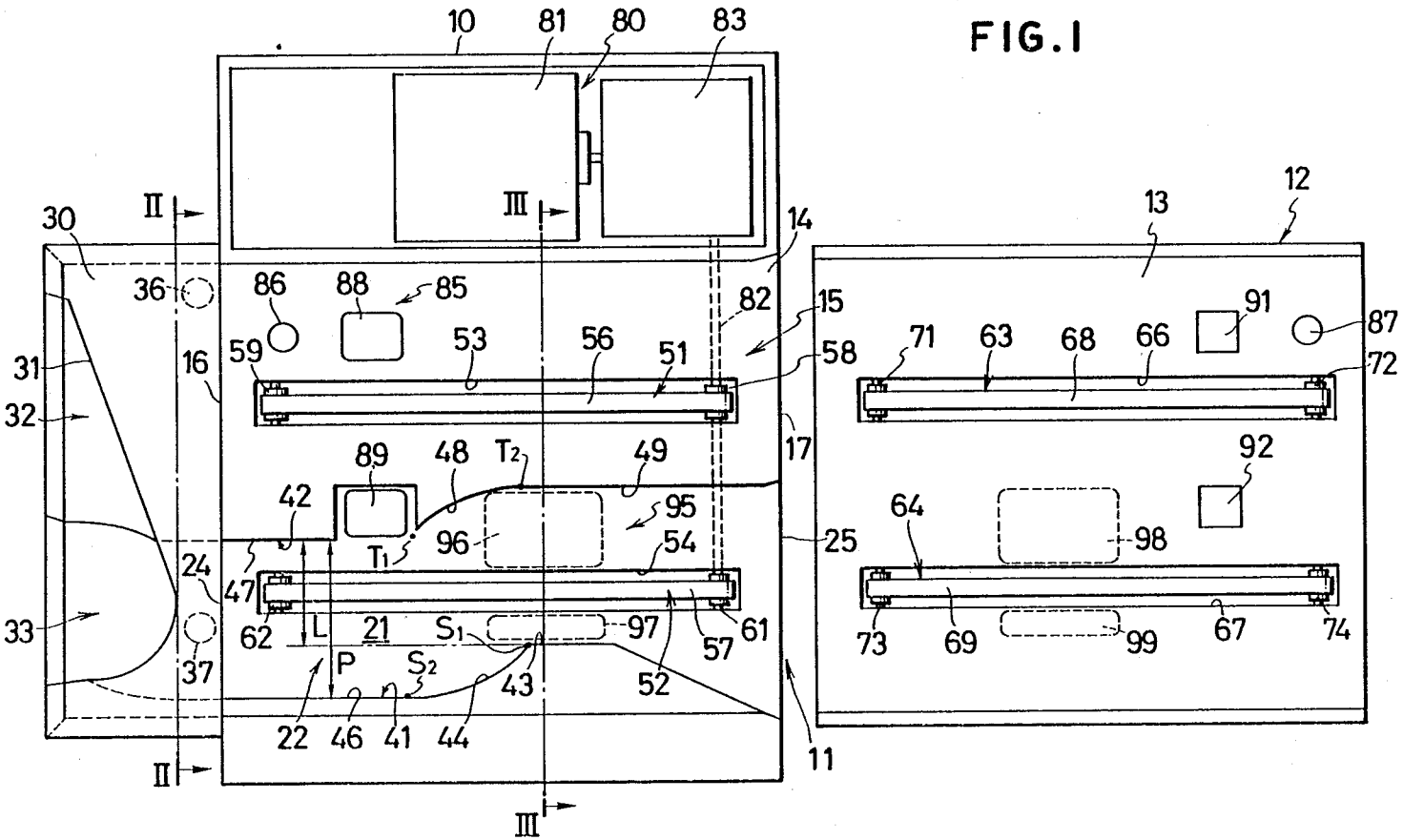
FIG. 1 is a side elevational view of a money discriminating apparatus according to an embodiment of the invention, in which one of a pair of plate-like members defining therebetween a bill transporting path is removed from the other plate-like member and is opened outwardly, in order to show a groove defining a coin transporting path.
Figure 4:
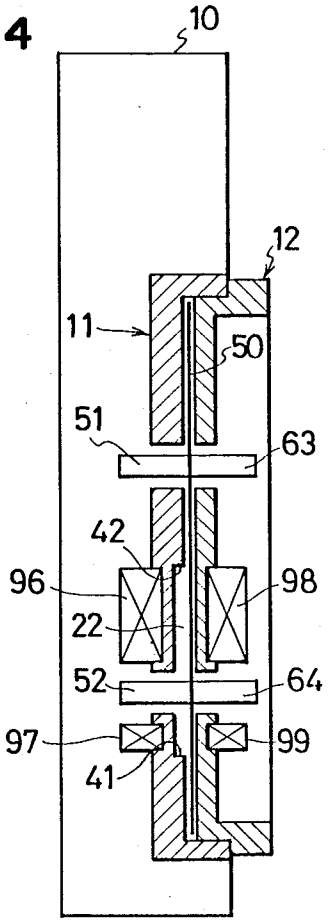
FIG. 4 is a view similar to FIG. 3, but showing a bill in course of being transported along the bill transporting path.
Figure 3:
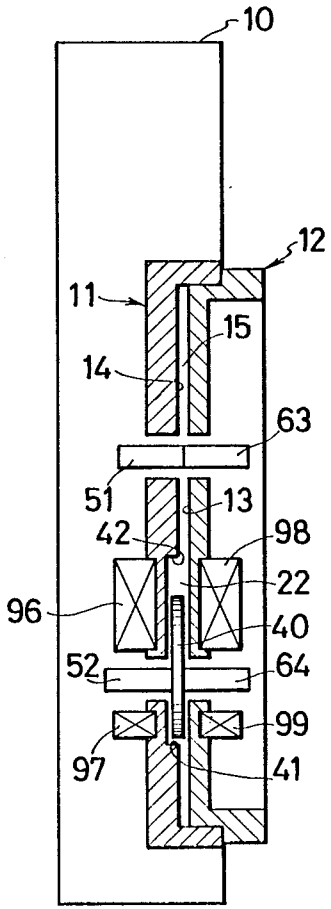
FIG. 3 is a cross-sectional view taken along the line III—III in FIG. 1 when the one plate-like member illustrated in FIG. 1 is fitted into the other plate-like member, showing a coin in course of being transported along the coin transporting path.

Referring to FIG. 1, there is shown a money discriminating apparatus according to an embodiment of the invention. The money discriminating apparatus comprises a body 10, a first plate-like member 11 incorporated in the body 10, and a second plate-like member 12 fixedly mounted to the first plate-like member 11. As will be seen from FIG. 2, the first plate-like member 11 is a channel member having a generally U-shaped cross-section. For convenience of illustration, FIG. 1 shows the second plate-like member 12 which is removed from the first plate-like member 11 and which is opened outwardly. With the second plate-like member 12 angularly moved in the counterclockwise direction about a left-hand side edge of the second plate-like member 12 as viewed in FIG. 1, the second plate-like member 12 is fixedly fitted into the first plate-like member 11 as shown in FIG. 3. That is, the second plate-like member 12 is fixedly fitted into the first plate-like member 11 in such a manner that an inner surface 13 of the second plate like member 12 is in spaced, but opposed relation to an inner surface 14 of the first plate-like member 11. The inner surfaces 14 and 13 of the respective first and second plate-like members 11 and 12 cooperate with each other to define therebetween a bill transporting path 15 as shown in FIGS. 3 and 4. The bill transporting path 15 has an inlet 16 on the lefthand side and an outlet 17 on the right-hand side as viewed in FIG. 1.

As shown in FIG. 1, a groove 21 is formed in the inner surface 14 of the first plate-like member 11. The groove 21 has a depth slightly larger than a thickness of the thickest one of coins to be transported, and a width slightly larger than a diameter of the largest one of the coins to be transported. The largest coin does means one having the maximum diameter. The groove 21 extends over the entire length of the first plate-like member 11. As shown in FIG. 3, the groove 21 formed in the inner surface 14 of the first plate-like member 11 cooperates with the inner surface 13 of the second plate-like member 12, to define therebetween a coin transporting path 22. The coin transporting path 22 has an inlet 24 and an outlet 25 which open respectively to the inlet 16 and the outlet 17 of the bill transporting path 15.

Figure 2:
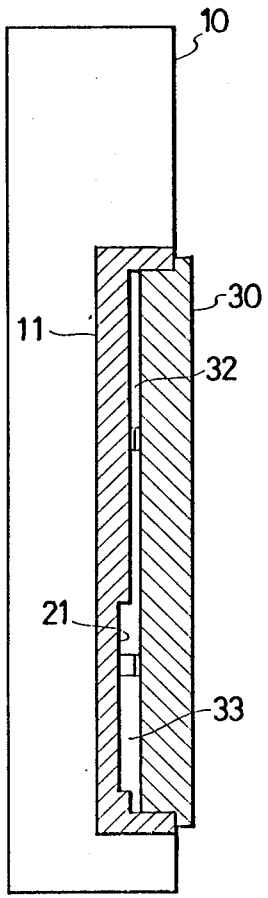
FIG. 2 is a cross-sectional view taken along the line II—II in FIG. 1.

A cover member 30 provided therein with a cut-out 31 is fitted into an end portion of the first plate-like member 11 projecting from the body 10 as shown in FIG. 2, to define a bill inserting opening 32 and a coin inserting opening 33. The bill inserting opening 32 communicates with the inlet 16 of the bill transporting path 15, while the coin inserting opening 33 communicates with the inlet 24 of the coin transporting path 22. A pair of sensors 36 and 37 are provided at the cover member 30. One of the pair of sensors 36 is arranged at a portion of the inlet 16 of the bill transporting path 15 except for the inlet 24 of the coin transporting path 22, while the other sensor 37 is arranged at the inlet 24 of the coin transporting path 22. The sensors 36 and 37 detect insertion of a bill into the bill inserting opening 32, to generate respective signals. The sensor 37 detects insertion of a coin into the coin inserting opening 33, to generate a signal.

As described previously, the groove 21 formed in the first plate-like member 11 has, as shown in FIG. 3, the width slightly larger than the diameter of the largest one of coins to be transporting along the coin transporting path 22, and the depth slightly larger than the thickness of the thickest one of coins to be transported along the coin transporting path 22. The groove 21 has a pair of opposed side surfaces formed respectively into guide surfaces 41 and 42. The guide surface 41 has a straight reference guide surface section 43 and an inclined guide surface section 44 which is connected to an upstream end of the straight reference guide surface section 43 remote from the outlet 25 of the coin transporting path 22 and which is inclined with respect to the straight reference guide surface section 43. The guide surface 41 further has a straight guide surface section 46 which is connected to an upstream end of the inclined guide surface section 44 remote from the outlet 25 of the coin transporting path 22. The straight guide surface section 46 extends to the inlet 24 of the coin transporting path 22 in parallel relation to the straight reference guide surface section 43. The guide surface 42 has a straight guide surface section 47 which is located between the straight reference guide surface section 43 of the guide surface 41 and the inlet 24 of the coin transporting path 24 and which has an upstream end at the inlet 24. The guide surface 42 also has an inclined guide surface section 48 which is connected to a downstream end of the straight guide surface section 47 and which is inclined with respect to the straight guide surface section 47. The guide surface 42 further has a straight guide surface section 49 which is connected to a downstream end of the inclined guide surface section 48 remote from the inlet 24 of the coin transporting path 22. The straight guide surface section 49 extends to the outlet 25 of the coin transporting path 22. The straight guide surface sections 47 and 49 of the guide surface 42 extend in parallel relation to the straight reference guide surface section 43 of the guide surface 41.

The width of the coin transporting path 22, that is, the shortest distance P between the straight guide surface sections 46 and 47 of the respective guide surfaces 41 and 42 is set to a value equal to or slightly larger than the diameter of the largest one of coins to be discriminated. Further, in a plane perpendicular to the straight guide surface section 47 of the guide surface 42, a straight distance L between a point where the straight guide surface section 47 of the guide surface 42 is intersected with the plane and a point where an extension line of the straight reference guide surface section 43 of the guide surface 41 is intersected with the plane, is set to a value equal to or smaller than a diameter of the smallest one of coins to be discriminated.

In the illustrated embodiment, the inclined guide surface sections 44 and 48 of the respective guide surfaces 41 and 42 are formed in an arcuate shape. These inclined guide surface sections 44 and 48 are similar in figure to each other and extend in facing relation to each other. More specifically, let it be supposed that a point where the straight reference guide surface section 43 and the inclined guide surface section 44 of the guide surface 41 are connected to each other is $S_1$, and a point where the straight guide surface section 47 and the inclined guide surface section 48 of the guide surface 42 are connected to each other is $T_1$. Then, the inclined guide surface section 44 is formed such that an arc of a radius equal to the above-mentioned distance P is drawn from the point $S_1$ about the point $T_1$, and the arc is tangentially connected to the straight guide surface section 46 at a point $S_2$. Likewise, the inclined guide surface section 48 is formed such that an arc having the radius P is drawn from the point $T_1$ about the point $S_1$, and the arc is tangentially connected to the straight guide surface section 49 at a point $T_2$. Accordingly, the straight distance between the points $T_1$ and $S_2$, the straight distance between the points $T_1$ and $S_1$ and the straight distance between the points $T_2$ and $S_1$ are equal to P.

The money discriminating apparatus comprises a transporting system for transporting a bill 50 from the inlet 16 to the outlet 17 of the bill transporting path 15 along the same as shown in FIG. 4, and a coin 40 from the inlet 24 to the outlet 25 of the coin transporting path 22 along the same as shown in FIG. 3. The transporting system comprises a pair of transporting belts 51 and 52 mounted on the first plate-like member 11 in parallel relation thereto. One of the pair of transporting belts 51 is arranged in a portion of the bill transporting path 15 except for the coin transporting path 22, while the other transporting belt 52 is arranged in the coin transporting path 22. The transporting belts 51 and 52 extend in parallel relation to the straight reference guide surface section 43 of the guide surface 41. The pair of transporting belts 51 and 52 are arranged respectively within a pair of elongated openings 53 and 54 provided in the first plate-like member 11. The transporting belt 51 has a running surface 56 exposed to the bill transporting path 15, while the transporting belt 52 has a running surface 57 exposed to the bill transporting path 15 and the coin transporting path 22. The transporting belt 51 is trained around a pair of pulleys 58 and 59 rotatably mounted to the first plate-like member 11. Likewise, the transporting belt 52 is trained around a pair of pulleys 61 and 62 rotatably mounted to the first plate-like member 11. Also mounted in parallel relation on the second plate-like member 12 are a pair of transporting belts 63 and 64 which are arranged respectively within a pair of elongated openings 66 and 67 provided in the second plate-like member 12. The transporting belt 63 has a running surface 68 exposed to the bill transporting path 15, while the transporting belt 64 has a running surface 69 exposed to the bill transporting path 15 and the coin transporting path 22. The transporting belt 63 is trained around a pair of pulleys 71 and 72 rotatably mounted to the second plate-like member 12. Likewise, the transporting belt 64 is also trained around a pair of pulleys 73 and 74 rotatably mounted to the second plate-like member 12. The running surface 68 of the transporting belt 63 is confronted with the running surface 56 of the transporting belt 51 in parallel relation thereto, and serves as a mating surface with which the transporting belt 51 cooperates. The running surface 69 of the transporting belt 64 is confronted with the running surface 57 of the transporting belt 52 in parallel relation thereto, and serves as a mating surface with which the transporting belt 52 cooperates. The transporting belts 51, 52, 63 and 64 are formed of a nonmagnetic resilient or elastic material such as rubber.

The above-mentioned transporting system comprises a drive unit 80 for driving the pair of transporting belts 51 and 52 mounted to the first plate-like member 11 to run the belts 51 and 52. The drive unit 80 is incorporated in the body 10 and comprises a motor 81 and a drive shaft 82 drivingly connected to an output shaft of the motor 81 through a reduction gear 83. Mounted on the drive shaft 82 for rotation therewith are the pulley 58 for the transporting belt 51 and the pulley 61 for the transporting belt 52. As the transporting belts 51 and 52 are driven by the drive unit 80, the transporting belts 51 and 52 cooperate respectively with the transporting belts 63 and 64 associated with the second plate-like member 12, to transport money in such a fashion that, if the money to be transported is a bill, the bill is clamped between the transporting belts 51 and 52 and the transporting belts 63 and 64 and is transported along the bill transporting path 15, while if the money to be transported is a coin, the coin is clamped between the transporting belts 52 and 64 and is transported along the coin transporting path 22.

A bill discriminating unit 85 is arranged in the portion of the bill transporting path 15 except for the coin transporting path 22, for discriminating authenticity and kind of the bill 50 in course of being transported by the above-mentioned transporting system along the bill transporting path 15 as shown in FIG. 4. The bill discriminating unit 85 is a conventionally known one comprising a photosensor 86 mounted to the first plate-like member 11 adjacent the inlet 16 of the bill transporting path 15. The photosensor 86 is adapted to cooperate with a light emitting element 87 mounted to the second plate-like member 12. The bill discriminating unit 85 also comprises a pair of bill inspecting elements 88 and 89 mounted to the first plate-like member 11 on either side of the transporting belt 51. A pair of pinch rollers 91 and 92 mounted to the second plate-like member 12 are designed to urge a bill transported along the bill transporting path 15, against the respective bill inspecting elements 88 and 89.

A coin discriminating unit 95 is mounted on the first plate-like member 11 in association with the coin transporting path 22, for discriminating authenticity and kind of the coin 40 in course of being transported by the above-mentioned transporting system along the coin transporting path 22 as shown in FIG. 3. The coin discriminating unit 95 comprises a pair of signal generating coils 96 and 97 positioned with respect to the straight reference guide surface section 43 of the guide surface 41. The signal generating coils 96 and 97 are mounted to the first plate-like member 11 such that the transporting belt 52 is located between the coils 96 and 97. The signal generating coils 96 and 97 are energized by signals of predetermined frequency. A pair of signal receiving coils 98 and 99 cooperating respectively with the pair of signal generating coils 96 and 97 are mounted to the second plate-like member 12 such that the transporting belt 64 is located between the coils 98 and 99. The signal receiving coils 98 and 99 are electromagnetically coupled respectively to the signal generating coils 96 and 97. The coin discriminating unit 95 discriminates authenticity and kind of a coin on the basis of an attenuation voltage wave form generated at the signal receiving coils 98 and 99 when the coin passes between the signal generating coils 96 and 97 and the signal receiving coils 98 and 99.

The operation of the money discriminating apparatus constructed as above will be described below. In a bill discriminating mode, as a bill is inserted into the bill inserting opening 32, the sensors 36 and 37 detect insertion of the bill to generate their respective signals. The motor 81 of the drive unit 80 is operative in response to the signals form the respective sensors 36 and 37 to rotate the drive shaft 82 through the reduction gear 83, thereby running the pair of transporting belts 51 and 52 mounted on the first plate-like member 11 at a constant speed. The transporting belts 51 and 52 cooperate respectively with the transporting belts 63 and 64 mounted on the second plate-like member 12 to transport the bill 50, as shown in FIG. 4, from the inlet 16 toward the outlet 17 along the bill transporting path 15 at a constant speed in such a fashion that the bill 50 is clamped between the transporting belts 51 and 52 and the transporting belts 63 and 64. The bill moves while being urged against the pair of bill inspecting elements 88 and 89 of the bill discriminating unit 85 by the respective pinch rollers 91 and 92. The bill discriminating unit 85 discriminates authenticity and kind of the bill in course of being transported along the bill transporting path 15. The bill having been discriminated is discharged through the outlet 17 of the bill transporting path 15.

In a coin discriminating mode, as a coin is inserted into the coin inserting opening 33, the sensor 37 detects insertion of the coin to generate a signal. The motor 81 of the drive unit 80 is operative in response to the signal from the sensor 37 to rotate the drive shaft 82 through the reduction gear 83, thereby running the pair of transporting belts 51 and 52 mounted on the first plate-like member 11 at a constant speed. The transporting belt 52 cooperates with the transporting belt 64 mounted on the second plate-like member 12 to transport, as shown in FIG. 3, the coin 40 from the inlet 24 toward the outlet 25 along the coin transporting path 22 at a constant speed in such a fashion that the coin 40 is clamped between the transporting belts 52 and 64. Since the inclined guide surface section 44 of the guide surface 41 is formed so as to gradually approach the transporting belt 52 from the straight guide surface section 46, the coin clamped between the transporting belts 52 and 64 is abutted against the inclined guide surface section 44. The coin abutted against the inclined guide surface section 44 is guided thereby against the clamping force due to the transporting belts 52 and 64 so that the coin is transported along the inclined guide surface section 44 toward the straight reference guide surface section 43. As a result, when the coin passes by the coin discriminating unit 95 which is positioned with respect to the straight reference guide surface section 43, the coin is urged at its lower side against the straight reference guide surface section 43 and is positioned. This ensures that the coin is transported along the straight reference guide surface section 43. The coin discriminating unit 95 discriminate authenticity and kind of the coin in course of being transported along the straight reference guide surface section 43. The coin having been discriminated is discharged through the outlet 25 of the coin transporting path 22.

Figure 5:
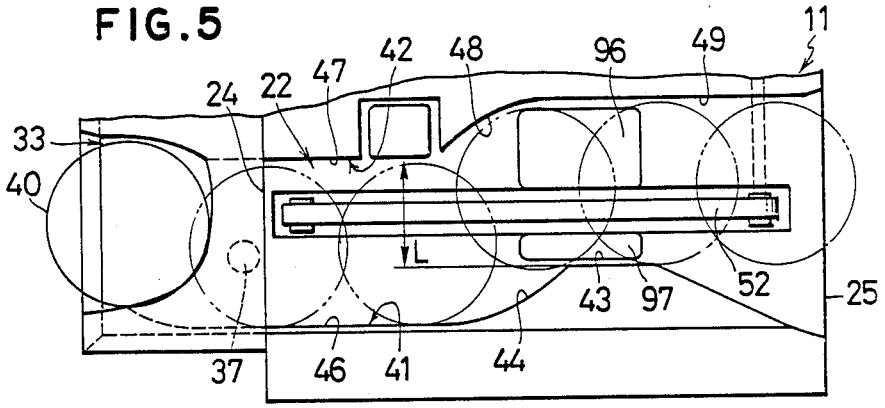
FIG. 5 is a fragmental side elevational view showing a moving locus of a coin having the maximum diameter in course of being transported along the coin transporting path.

FIG. 5 shows a state in which the coin 40 having the maximum diameter, of coins to be discriminated, is transported along the coin transporting path 22. As mentioned previously, the coin 40 transported by the transporting belts 52 and 64 is abutted against the inclined guide surface section 44, is guided by the latter to the straight reference guide surface section 43, and is moved along the latter. The coin 40 passes in front of the pair of signal generating coils 96 and 97 of the coin discriminating unit 95 in such a fashion as to substantially cover the coils 96 and 97. The coin 40 is discriminated in its authenticity and kind by the coin discriminating unit 95.

Figure 6:
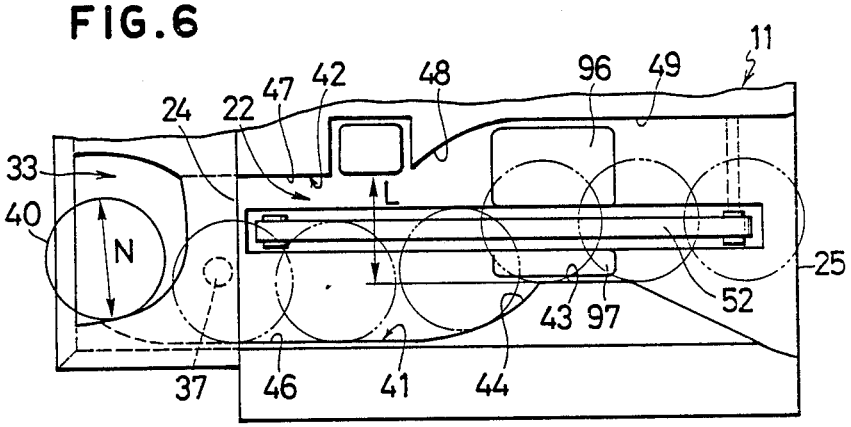
FIG. 6 is a view similar to FIG. 5, but showing a moving locus of a coin having the minimum diameter in course of being transported along the coin transporting path.

FIG. 6 shows a state in which the coin 40 having the minimum diameter, of coins to be discriminated, is transported along the coin transporting path 22. As mentioned previously, the distance L between the straight guide surface section 47 of the guide surface 42 and the straight reference guide surface section 43 of the guide surface 41 is set to the value equal to or slightly smaller than the diameter N of the smallest coin 40. Accordingly, it is ensured that the outer peripheral surface of the minimum coin 40 transported by the transporting belts 52 and 64 is abutted against the inclined guide surface section 44 of the guide surface 41. That is, regardless of the size of the outer diameter of the coin 40, and even though the coin 40 is clamped between the transporting belts 52 and 64 at any location widthwise of the inlet 24 of the coin transporting path 22, it is ensured that the coin transported by the transporting belts 52 and 64 is abutted against the inclined guide surface section 44 of the guide surface 41, and is guide by the inclined guide surface section 44 to the straight reference guide surface section 43. Thus, the coin discriminating unit 95 positioned based on the straight reference guide surface section 43 can accurately discriminate the outer diameter, material and thickness of the coin 40.

Figure 7:
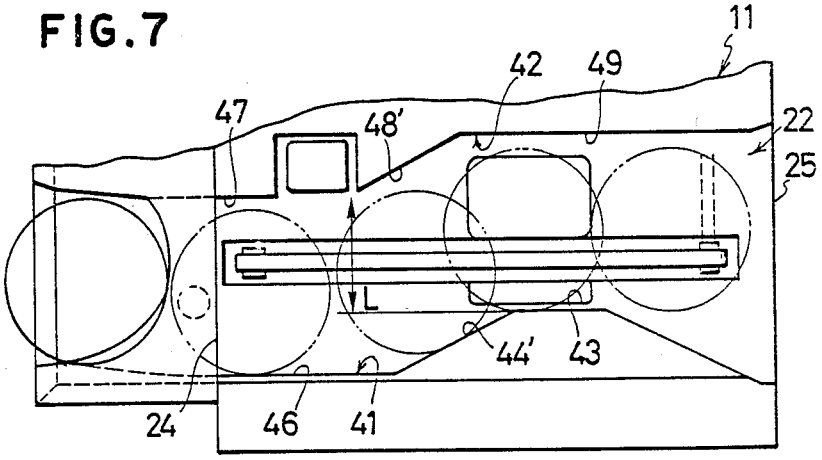
FIG. 7 is a view similar to FIG. 5, but showing a modification of an inclined guide surface section for guiding coins.

In the above embodiment, it has been described that the inclined guide surface sections 44 and 48 of the respective guide surfaces 41 and 42 are formed in an arcuate shape. As shown in FIG. 7, however, the inclined guide surface sections may be formed in a straight shape as designated by the reference numerals 44' and 48'. The modification illustrated in FIG. 7 can also operate in a manner like that of the embodiment described with reference to FIGS. 1 through 6. In FIG. 7, accordingly, like or similar reference numerals are used to designate components and parts like or similar to those shown in FIGS. 1 through 6, and the description of such like or similar components and parts will therefore be omitted.

As described above, it is ensured that the coin inserted through the coin inserting opening 33 and transported by the transporting belts 52 and 64 is abutted against the inclined guide surface section 44 of the guide surface 41. Thus, the coin is guided by the inclined guide surface section 44 to the straight reference guide surface section 43 and is transported while the outer peripheral surface of the coin is in contact with the straight reference guide surface section 43. Accordingly, the coin discriminating unit 95 determined in position with respect to the straight reference guide surface section 43 can discriminate, in a stable manner, the coin passing through a fixed position with respect to the coin discriminating unit 95 regardless of the size of the outer diameter of the coin.

In addition, since the coin passes through the predetermined position along the straight reference guide surface section 43 and is transported at the constant speed by the transporting belts 52 and 64, the coin discriminating unit 95 can discriminate the coin in an accurate and stable manner. In particular, as compared with the conventional system in which, while a coin falls under the gravity, the coin is discriminated by the discriminating unit, the speed and the position of the coin passing by the coin discriminating unit 95 do not vary, but are constant, even if the coin transporting path 22 is oriented in any direction. This makes it possible to simplify the structure of the coin discriminating unit 95, and to correctly and accurately discriminate the authenticity and kind of the coin. Further, it can be prevented that the coin lodges in the coin transporting path due to adhesive contamination adhering to the coin.

Although the above embodiment has been described and illustrated as having the bill transporting path 15 and the coin transporting path 22 which are arranged vertically, it is to be understood that the invention is not limited to this specific form. That is, since the bill and the coin are transported while being clamped between the transporting belts 51 and 52 and the transporting belts 63 and 64, the bill transporting path 15 and the coin transporting path 22 are not necessarily required to be arranged vertically, but may be arranged horizontally or may be arranged in such a fashion as to be inclined at an angle with respect to the horizontal plane. Since, in this manner, the orientation of the transporting paths 15 and 22 is not limited to any specific direction, the money discriminating apparatus can be arranged in any optimum orientation in accordance with the design of the money handling machine such as an automatic vending machine and a money exchange machine in which the money discriminating apparatus is to be incorporated. This makes it possible to increase the degree of freedom in design of the money handling machine.

In the above embodiment and modification, it has been described that the mating surfaces, with which the transporting belts 51 and 52 mounted on the first plate-like member 11 cooperate respectively, are the running surfaces 68 and 69 of the respective transporting belts 63 and 64. However, the mating surfaces are not necessarily required to be the running surfaces of the transporting belts. That is, the mating surfaces may be formed respectively by fixed wall surfaces. In this case, the transporting belts 51 and 52 mounted on the first plate-like member 11 should be biased by biasing means such as springs or the like, toward the respective mating surfaces in such a manner that when a bill is not transported, a gap less than the minimum thickness of the coin is formed between the transporting belts 51 and 52 and the mating surfaces. By doing so, it can be prevented that the transporting belts 51 and 52 are in sliding contact with the respective mating surfaces and are worn off. If is preferable that members forming the fixed mating surfaces are formed of material low in coefficient of friction. It is of course that the mating surfaces may be formed by a single common mating surface.

Moreover, in the above embodiment and modification, it has been described that, when a coin is inserted into the coin inserting opening 33, the transporting belt 51 arranged in the portion of the bill transporting path 15 except for the coin transporting path 22 is also driven. It is needless to say, however, that only the transporting belt 52 arranged in the coin transporting path 22 may be driven.

Furthermore, although the groove 21 defining the coin transporting path 22 is formed only in the inner surface 14 of the first plate-like member 11, another groove may be formed in the inner surface 13 of the second plate-like member 12 such that the coin transporting path 22 is defined by the pair of grooves provided respectively in the inner surfaces 14 and 13 of the first and second plate-like members 11 and 12.

As described above, the arrangement of the money discriminating apparatus according to the invention is such that the coin transporting path is defined by the groove formed in at least one of the pair of wall surfaces which define therebetween the bill transporting path, and that the coin transporting path has the inlet and the outlet which open respectively to the inlet and the outlet of the bill transporting path. With such arrangement, it is possible to increase the number of component parts which are common to transportation and discrimination of the bill and transportation and discrimination of the coin. Thus, the money discriminating apparatus can be made simple and compact in structure, resulting in a reduction of the manufacturing cost of the money discriminating apparatus.

In addition, the arrangement of the money discriminating apparatus according to the invention is such that a coin is transported at a constant speed while being clamped between the transporting belt means and the mating surface means. With such arrangement, even if contamination adheres to the coin, even if the coin is deformed slightly, and even if the sides of the bill and the sides of the coin assume any of the vertical, horizontal and inclined postures in the money transporting path, it can be ensured that the coin is transported to the coin discriminating means, and is caused to pass by the coin discriminating means at a constant speed. Thus, the coin discriminating means can discriminate the coin in a stable manner. Further, even if the money discriminating apparatus is oriented in any direction, the discriminating operation of the money discriminating apparatus is not influenced by the orientation, so that it is possible to increase the degree of freedom in design of the money handling machine having incorporated therein the money discriminating apparatus.

Further, in the above embodiment, it has been described that the coin transporting path is arranged within the bill transporting path, and that, of the transporting belts 51 and 52 mounted on the first plate-like member 11 and the transporting belts 63 and 64 mounted on the second plate-like member 12, the transporting belts 52 and 64 serve as shared transporting belts for carrying out bill transportation and coin transportation. As another embodiment, however, the coin transporting path 22 may be arranged outside of the bill transporting path, and additional belts may be provided which independently carries out coin transportation.

In case where the coin transporting path is provided outside of the bill transporting path, the coin transporting path 22 should, for example, be arranged in parallel relation to the bill transporting path, and transporting belts should additionally be provided for transporting coins along the outside coin transporting path. Alternatively, the coin transporting path and the bill transporting path may be arranged in such a double story fashion that the coin transporting path overlaps half the bill transporting path. In this case, the coin transporting belts are arranged in the coin transporting path and are connected to the drive shaft 82 through a known transmission mechanism.

It is of course that in case where the coin transporting path is separately provided, a sensor other than the sensors 36 and 37 provided at the inlet is additionally arranged at the inlet of the coin transporting path to carry out the requisite control. Moreover, it is also needles to say that the coin transporting path may be provided in a completely separate fashion. In this case and in the above-mentioned case, it is of course that the coin transporting path is constructed in a manner like that having already been described. Furthermore, since the coin transportation does not rely upon free falling, the money discriminating apparatus of the invention does not become complicated in structure unlike the conventional apparatus, but is simple in construction. Thus, only a small space is required for installation of the apparatus according to the invention. Further, the apparatus of the invention also has such advantages that a manner of mounting or installing the apparatus to the automatic vending machine and the like is free, and the apparatus is not influenced by contamination and vibration.

What is claimed is:

1. A money discriminating apparatus comprising:

a bill transporting path defined between a pair of spaced, but opposed wall surfaces, said bill transporting path having at its one end an inlet and at the other end an outlet;

a coin transporting path defined by a groove formed in at least one of said pair of wall surfaces, said groove having a width slightly larger than a diameter of one having a maximum diameter, of coins to be transported, and a depth slightly larger than a thickness of one having maximum thickness, of the coins to be transported, said coin transporting path having an inlet and an outlet which open respectively to the inlet and the outlet of said bill transporting path, said coin transporting path being provided substantially within a space in which said bill transporting path is provided;

transporting means for transporting a bill from the inlet to the outlet of said bill transporting path along the same and for transporting a coin from the inlet to the outlet of said coin transporting path along the same;

bill discriminating means arranged in association with said bill transporting path, for automatically discriminating the authenticity and kind of the bill in course of being transported by said transporting means along said bill transporting path; and coin discriminating means arranged in association with said coin transporting path, for discriminating authenticity and kind of the coin in course of being transported by said transporting means along said coin transporting path.

2. A money discriminating apparatus as defined in claim 1, wherein said transporting means transports, at a constant speed, the bill along said bill transporting path, and the coin along said coin transporting path.

3. A money discriminating apparatus as defined in claim 2, wherein said transporting means comprises transporting belt means having a running surface, and mating surface means arranged in facing relation to said running surface of said transporting belt means, and drive means for driving said transporting belt means to run the same, the arrangement being such that when said transporting belt means is driven by said drive means, the running surface of said transporting belt means cooperates with said mating surface means to transport the coin while clamping the coin between the running surface of said transporting belt means and said mating surface means.

4. A money discriminating apparatus as defined in claim 3, wherein said mating surface means is formed by second transporting belt means having a running surface confronted with the running surface of the first-mentioned transporting belt means.

5. A money discriminating apparatus as defined in claim 1, wherein said groove defining said coin transporting path has a pair of side surfaces, one of said pair of side surfaces being formed into a guide surface, said guide surface having a straight reference guide surface section and an inclined guide surface section which is connected to an upstream end of said straight reference guide surface section remote from the outlet of said coin transporting path and which is inclined with respect to said straight reference guide surface section, said coin discriminating means being determined in position with respect to said straight reference guide surface section, the arrangement being such that the coin transported by said transporting means along said coin transporting path is abutted against said inclined guide surface section, is guided by said inclined guide surface section to said straight reference guide surface section, and moves along said straight reference guide surface section.

6. A money discriminating apparatus as defined in claim 5, wherein the other of said pair of side surfaces of said groove is formed into a second guide surface, said second guide surface having a straight guide surface section located between the inlet of said coin transporting path and said inclined guide surface section of the first-mentioned guide surface, said straight guide surface section of said second guide surface extending in parallel relation to said straight reference guide surface section of the first-mentioned guide surface, wherein in a plane perpendicular to said straight guide surface section of said second guide surface, a straight distance between a point where said straight guide surface section of said second guide surface is intersected with said plane and a point where an extension line of said straight reference guide surface section of the first-mentioned guide surface is intersected with said plane is at most equal to a diameter of a smallest one of coins to be transported.

7. A money discriminating apparatus as defined in claim 6, wherein said second guide surface has an inclined guide surface section which is connected to a downstream end of said straight guide section of said second guide surface remote from the inlet of said coin transporting path and which is inclined with respect to said straight guide surface section of said second guide surface, said inclined guide surface section of said second guide surface being similar in figure to said inclined guide surface section of the first-mentioned guide surface, said inclined guide surface section of said second guide surface extending in facing relation to said inclined guide surface section of the first-mentioned guide surface.

8. A money discriminating apparatus as defined in claim 7, wherein each of the respective inclined guide surface sections of the first-mentioned guide surface and said second guide surface extends in an arcuate form.

9. A money discriminating apparatus as defined in claim 7, wherein each of the respective inclined guide surface sections of the first-mentioned guide surface and said second guide surface extends straight.

10. A money discriminating apparatus comprising:

a bill transporting path defined between a pair of spaced, but opposed wall surfaces, said bill transporting path having at its one end an inlet and at the other end an outlet;

a coin transporting path defined by a groove formed in at least one of said pair of wall surfaces, said groove having a width slightly larger than a diameter of one having a maximum diameter, of coins to be transported, and a depth slightly larger than a thickness of one having a maximum thickness, of the coins to be transported, said coin transporting path having an inlet and an outlet which open respectively to the inlet and the outlet of said bill transporting path;

transporting means for transporting a bill from the inlet to the outlet of said bill transporting path along the same and for transporting a coin from the inlet to the outlet of said coin transporting path along the same;

bill discriminating means arranged in association with said bill transporting path, for discriminating authenticity and kind of the bill in course of being transported by said transporting means along said bill transporting path; and coin discriminating means arranged in association with said coin transporting path, for discriminating authenticity and kind of the coin in course of being transported by said transporting means along said coin transporting path; and wherein said transporting means transports, at a constant speed, the bill along said transporting path and the coin along said coin transporting path;

said transporting means transporting belt means having a running surface, and mating surface means arranged in facing relation to said running surface of said transporting belt means, and drive means for driving said transporting belt means to run the same, the arrangement being such that when said transporting belt means is driven by said drive means, the running surface of said transporting belt means cooperates with said mating surface means to transport the coin while clamping the coin between the running surface of said transporting belt means and said mating surface means;

said mating surface means is formed by second transporting belt means having a running surface confronted with the running surface of the first-mentioned transporting belt means; and the first-mentioned transporting belt means comprises a pair of transporting belts extending in parallel relation to each other, one of said pair of transporting belts being arranged along a portion of said bill transporting path except for said coin transporting path, the other transporting belt being arranged along said coin transporting path, and wherein said second transporting belt means comprises a pair of transporting belts arranged in facing relation respectively to said pair of transporting belts of the first-mentioned belt means.

11. A money discriminating apparatus comprising:

a coin transporting path defined by a groove formed in at least one of a pair of spaced, but opposed wall surfaces, said groove having a width slightly larger than a diameter of one having a maximum diameter, of coins to be transported, and a depth slightly larger than a thickness of one having a maximum thickness, of the coins to be transported, said coin transporting path having an inlet and an outlet;

transporting means for transporting a coin at a constant speed from the inlet to the outlet of said coin transporting path along the same; and coin discriminating means arranged in association with said coin transporting path, for discriminating authenticity and kind of a coin in course of being transported by said transporting means along said coin transporting path, wherein said transporting means comprises transporting belt means having a running surface, and mating surface means arranged in facing relation to said running surface of said transporting belt means, and drive means for driving said transporting belt means to run the same, the arrangement being such that when said transporting belt means is driven by said drive means, the running surface of said transporting belt means cooperates with said mating surface means to transport the coin while clamping the coin between the running surface of said transporting belt means and said mating surface means; and wherein said mating surface means is formed by second transporting belt means having a running surface confronted with the running surface of the first-mentioned transporting belt means.

12. A money discriminating apparatus comprising:

a coin transporting path defined by a groove formed in at least one of a pair of spaced, but opposed wall surfaces, said groove having a width slightly larger than a diameter of one having a maximum diameter, of coins to be transported, and a depth slightly larger than a thickness of one having a maximum thickness, of the coins to be transported, said coin transporting path having an inlet and an outlet;

transporting means for transporting a coin at a constant speed from the inlet to the outlet of said coin transporting path along the same; and coin discriminating means arranged in association with said coin transporting path, for discriminating authenticity and kind of a coin in course of being transported by said transporting means along said coin transporting path, wherein said transporting means comprises transporting belt means having a running surface, and mating surface means arranged in facing relation to said running surface of said transporting belt means, and drive means for driving said transporting belt means to run the same, the arrangement being such that when said transporting belt means is driven by said drive means, the running surface of said transporting belt means cooperates with said mating surface means to transport the coin while clamping the coin between the running surface of said transporting belt means and said mating surface means; and wherein said groove defining said coin transporting path has a pair of side surfaces, one said pair of side surfaces being formed into a guide surface, said guide surface having a straight reference guide surface section and an inclined guide surface section which is connected to an upstream end of said straight reference guide surface section remote from the outlet of said coin transporting path and which is inclined with respect to said straight reference guide surface section, said coin discriminating means being determined in position with respect to straight reference guide surface section, the arrangement being such that the coin transported by said transporting means along said coin transporting path is abutting against said inclined guide surface section, is guided by said inclined guide surface section to said straight reference guide surface section, and moves along said straight reference guide surface section.

13. A money discriminating apparatus as defined in claim 12, wherein the other of said pair of side surfaces of said groove is formed into a second guide surface, said second guide surface having a straight guide surface section located between the inlet of said coin transporting path and said inclined guide surface section of the first-mentioned guide surface, said straight guide surface section of said second guide surface extending in parallel relation to said straight reference guide surface section of the first-mentioned guide surface, wherein in a plane perpendicular to said straight guide surface section of said second guide surface, a straight distance between a point where said straight guide surface section of said second guide surface is intersected with said plane and a point where an extension line of said straight reference guide surface section of the first-mentioned guide surface is intersected with said plane is at most equal to a diameter of a smallest one of coins to be transported.

14. A money discriminating apparatus as defined in claim 13, wherein said second guide surface has an inclined guide surface section which is connected to a downstream end of said straight guide surface has an said second guide surface remote from the inlet of said coin transporting path and which is inclined with respect to said straight guide surface section of said second guide surface, said inclined guide surface section of said second guide surface being similar in figure to said inclined guide surface section of the first-mentioned guide surface, said inclined guide surface section of said second guide surface extending in facing relation to said inclined guide surface section of the first-mentioned guide surface.

15. A money discriminating apparatus as defined in claim 14, wherein each of the respective inclined guide surface sections of the first-mentioned guide surface and said second guide surface extends in an arcuate form.

16. A money discriminating apparatus as defined in claim 14, wherein each of the respective inclined guide surface sections of the first-mentioned guide surface and said second guide surface extends straight.

* * * * *